United States Patent [19]

Maeda

[11] 4,121,408

[45] Oct. 24, 1978

[54] DOUBLED-YARN OF ELASTIC AND NON-ELASTIC YARNS AND METHOD AND APPARATUS FOR PRODUCING SAME

[76] Inventor: Senichi Maeda, 462 Shinhakusuimarucho, Ichijo Sagaru, Chiekoindori, Kamigyo-ku, Kyoto, Japan

[21] Appl. No.: 817,180

[22] Filed: Jul. 20, 1977

[30] Foreign Application Priority Data

Sep. 9, 1976 [JP] Japan ..... 51-108986

[51] Int. Cl.[2] ..... D02G 3/32; D02G 3/26

[52] U.S. Cl. ..... 57/12; 57/34 AT; 57/163; 57/168

[58] Field of Search ..... 57/12, 19, 34 AT, 152, 57/163, 168; 242/159

[56] References Cited

U.S. PATENT DOCUMENTS

| | | | |
|---|---|---|---|
| 3,255,579 | 6/1966 | Price | 57/12 |
| 3,434,275 | 3/1969 | Backer et al. | 57/34 AT |
| 3,443,370 | 5/1969 | Walls | 57/34 AT |
| 3,999,361 | 12/1976 | Ellis et al. | 57/34 AT |

*Primary Examiner*—Charles Gorenstein

[57] ABSTRACT

A double-yarn package of elastic and non-elastic yarns is produced by preparing a non-elastic yarn twisted periodically and alternately in opposite directions, doubling an elastic yarn which is in a stretched condition with said twisted non-elastic yarn, twisting the doubled yarn periodically and alternately in such directions as are opposite to the directions of said periodical and alternate twist of said non-elastic yarn, and then winding the thus twisted doubled yarn on a winding core.

5 Claims, 4 Drawing Figures

A
2
4
24a
23a
34a
32a
33a
31a
27a
29a
30a
25a
26a
28a
21a
22a
20a
5
11
B
10
25b
29b
33b
32b
27b
28b
26b
30b
31b
20b
22b
21b
23b
24b
35b
6
C
34b

DOUBLED-YARN OF ELASTIC AND NON-ELASTIC YARNS AND METHOD AND APPARATUS FOR PRODUCING SAME

BACKGROUND OF THE INVENTION

The present invention relates to a double yarn package composed of an elastic yarn, such as Spandex (polyurethane fiber), and a non-elastic yarn, such as wooly Nylon (stretch yarn made of polyamide) and obtained in such a condition that it can be effectively used in knitting operation on the knitting machine and it also relates to a method and apparatus for producing the same.

In obtaining a doubled yarn as described above, the use of a method in which a stretched elastic yarn and a non-elastic yarn are simply doubled together and wound into a cheese would result in only the elastic yarn cutting deep into the cheese due to its contractive force, causing the separation of the elastic and non-elastic yarns from each other when drawing out the doubled yarn as in knitting operation on the knitting machine, so that the elastic and non-elastic yarns cannot be drawn out in the same proportions and hence they cannot be used as a doubled yarn. Conventionally, in view of this fact, in order to obtain such doubled yarn a method has been employed in which a stretched elastic yarn is doubled with a non-elastic yarn and the doubled yarn is then twisted and heat-set, thereby twining both yarns together and setting them in that condition. Since such method involves heat-setting or other processes for setting the twisted condition, the manufacturing process is complicated and high speed production is impossible. Thus, the method has the disadvantage of being inefficient and uneconomical.

I have previously proposed a method of producing a doubled-yarn package of elastic and non-elastic yarns with the object of obtaining a yarn package enabling a doubled yarn composed of elastic and non-elastic yarns to be drawn out in the same proportions, wherein elastic and non-elastic yarns are doubled together and then twisted periodically and alternately in opposite directions, whereupon the doubled yarn is wound as a package such as a cheese or cone. According to this method, an elastic yarn which is in stretched condition is doubled and the resulting doubled yarn is wound into a cheese or the like in alternately twisted condition. When such doubled-yarn is drawn out, untwisting is involved, but since the elastic and non-elastic yarns are drawn out in the same proportions, it follows that there will be no problem in practice in using it in knitting operation on the knitting machine even if it is not set in intimately twined condition as in covered yarn.

In the yarn package obtained by such method, however, it is the undeniable fact that the twist is hard in some places and soft in other places and that at point where the direction of twist changes there are so-called twist-free portions extending over a considerable length. This is because it is wound without means of setting the twist as by heat setting. If the elastic yarn used is very fine, e.g. 20 deniers, the doubled yarn, when left for a day or two on a cheese will temporarily retain the stretched condition, so that the doubled yarn which has been alternately twisted can be maintained in that condition even wound into a cheese. However, if the elastic yarn is 40 deniers or above, such temporary strain is so small in amount that upon being stretched the yarn begins to untwist continuously.

In doubling elastic and non-elastic yarns together, subjecting the doubled yarn to alternate twisting and winding the yarn, the present invention is intended to obtain a doubled yarn package of elastic and non-elastic yarns wherein the alternate twist in the elastic yarn and in the non-elastic yarn is stably retained while minimizing the twist-free portions.

SUMMARY OF THE INVENTION

The doubled-yarn package of elastic and non-elastic yarns according to the invention is characterized in that a non-elastic yarn which has been first-twisted periodically and alternately in opposite directions and an elastic yarn which is in stretched condition are doubled together and the resulting doubled yarn is given periodic alternate second-twist in the directions opposite to the directions of the first-twist and is wound on a winding core.

According to the invention, since the non-elastic yarn is given first-twist in advance which is in the directions opposite to the directions of the alternate twist given to the doubled yarn of elastic and non-elastic yarns, the second-twist in the elastic and non-elastic yarns is stably retained, having no possibility of untwisting and the twist-free portions can be minimized. Therefore, the product according to the invention, as compared with a conventional heat-set doubled yarn, causes no inconveniences in use and the absence of a torque (distortion) improves the quality of the alternately twisted doubled yarn. Another feature is that since there is no need for additional processes including heat-setting, the article of the invention can be produced at a high speed which cannot be compared with that for a conventional covered or doubled twisted yarn.

The degree of twist and the period of alternate twist can be freely selected according to the quality of yarns used and application of the product. Further, the degree of stretch of the elastic yarn can be freely selected according to quality and application. For example, if spandex (polyurethane elastic yarn) is used as an elastic yarn and wooly nylon as a non-elastic yarn, it is advisable that the elastic yarn be stretched to have 3–4 times its free length when it is doubled with the non-elastic yarn. Further, it is desirable that the first twist of the non-elastic yarn be harder than the second twist of the doubled yarn of the elastic and non-elastic yarns.

In order to carry out the operation of applying second twist in the form of alternate twist so as to double the elastic and non-elastic yarns together after applying first twist in the form of alternate twist to the non-elastic yarn, as described above, it is necessary that the non-elastic yarn be subjected to the second twist along with the elastic yarn in such a condition that the first twist in the form of alternate twist imparted to the non-elastic yarn maintains its existing condition. In this connection, in order to bring the non-elastic yarn to the process for second-twisting it along with the elastic yarn while retaining alternate twist imparted to the non-elastic yarn, a special method and device are needed.

According to the present invention, as an effective method of producing a doubled-yarn package of elastic and non-elastic yarns, as described above, there is provided a method of producing a doubled-yarn package of elastic and non-elastic yarns, characterized in that the method comprises imparting first twist to a non-elastic yarn alternately in opposite directions at a first operating station, doubling an elastic yarn which is in stretched condition with said first-twisted non-elastic yarn at a second operating station, and imparting second twist to the doubled yarn alternately in opposite directions at a third operating station and then winding it on a winding core such as a cheese or cone, wherein the first twisting of the non-elastic yarn at said first operating station and the second twisting of the doubled yarn at said third operating station are simultaneously effected with the feeding of the respective yarns stopped, the directions of the first twist at said first operating station being opposite to the directions of the second twist at said third operating station, the elastic and non-elastic yarns at said second operating station being held stationary during the twisting operations at said first and third operating stations, and wherein after the first and second twists have been imparted in fixed amounts and in fixed directions on both sides of said second operating station, the first and second twisting operations at said first and third operating stations, respectively, are stopped, whereupon the second-twisted doubled yarn and the first-twisted non-elastic yarn are clipped immediately after they leave the second and first operating stations, respectively, whereupon they are forwardly moved until their clipped positions reach the third and second operating stations respectively.

Further, according to the invention, as an apparatus for producing a doubled-yarn package of elastic and non-elastic yarns, as described above, there is provided an apparatus for producing a double-yarn package of elastic and non-elastic yarns, characterized in that the apparatus comprises a first operating station provided with a non-elastic yarn first-twisting mechanism for imparting first twist to a non-elastic yarn, a second operating station spaced a fixed distance forwardly of said first operating station and adapted to double an elastic yarn which is in stretched condition with said non-elastic yarn first-twisted by said first-twisting mechanism, a third operating station spaced a fixed distance forwardly of said second operating station and provided with a second-twisting mechanism for imparting second twist to the double yarn composed of said elastic yarn and first-twisted non-elastic yarn, a winding mechanism spaced forwardly of said third operating station for winding the doubled yarn second-twisted at said third operating station, said second operating station being provided with a twist retaining mechanism for arresting said elastic and non-elastic yarns, a first twisted non-elastic yarn clipping mechanism movable from said first to said second operating station, and a second-twisted doubled yarn clipping mechanism movable from said second to said third operating station.

DETAILED DESCRIPTION OF THE PREFERRED EMBODIMENTS

A method and apparatus for producing a doubled-yarn package of elastic and non-elastic yarns according to an embodiment of the present invention will now be described with reference to the drawings.

Figure 1:
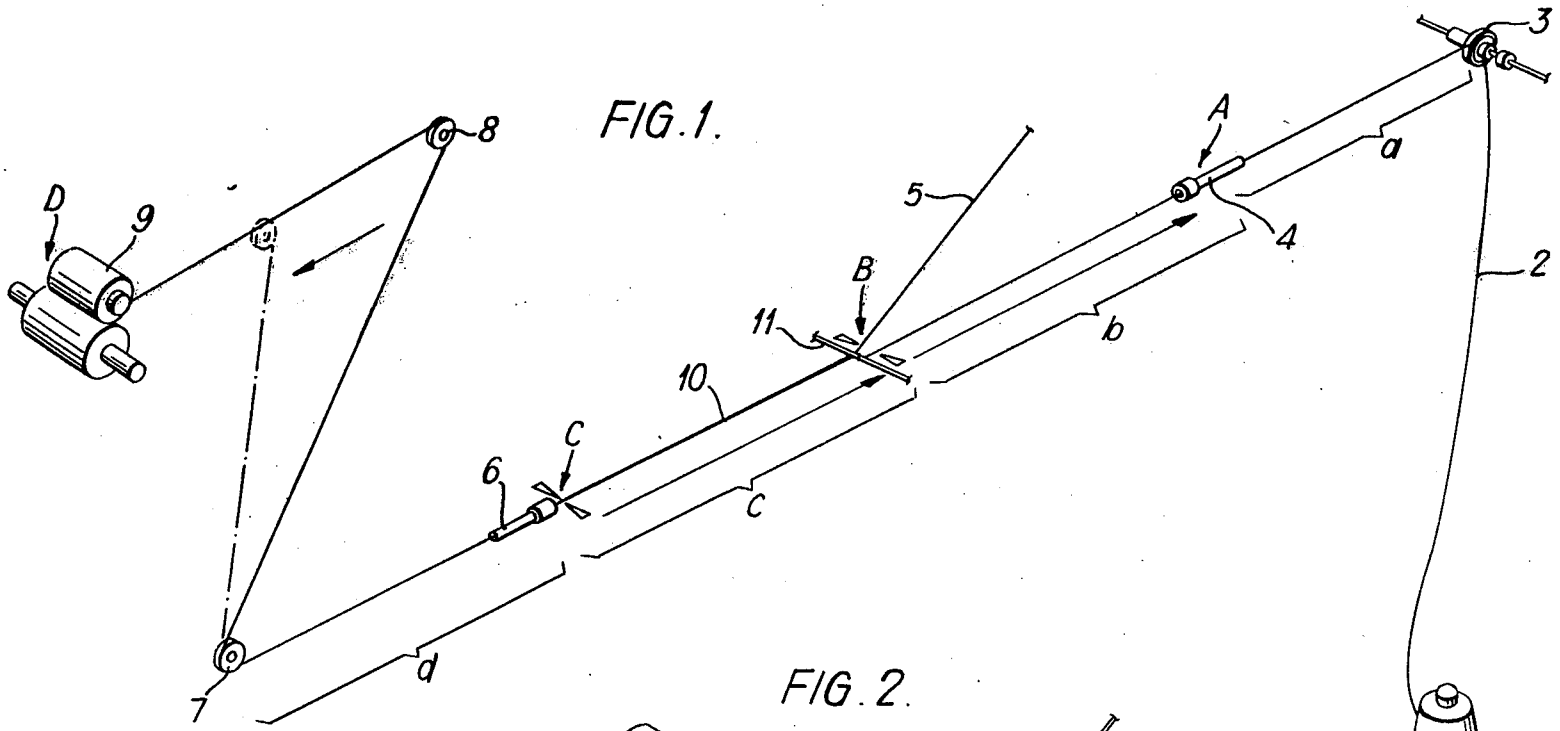
FIG. 1 is a perspective view showing an outline of the operating process of the method according to the present invention.

In FIG. 1, a non-elastic yarn 2, such as wooly nylon, withdrawn from a cone 1 is passed around a guide and tension device 13 to a first operating station A, where it is first-twisted by a first-twisting mechanism 4, and then, at a second operating station B it is doubled with an elastic yarn 5, such as polyurethane elastic yarn, which is in stretched condition, the doubled yarn being then second-twisted by a second-twisting mechanism 6 at a third operating station C, whereupon it is passed around a guide pulley 7 and a dancing pulley 8 and it is wound on a cheese 9 at a winding station D.

The first-twisting and second-twisting mechanisms 4 and 6 are used for twisting the non-elastic yarns 2 and the doubled yarn (shown at 10) alternately in opposite directions, respectively and such alternately twisting mechanisms themselves may be conventional ones. For example, it is possible to make use of a known false twisting spindle comprising a needle around which a yarn is wound a single turn and a hollow spindle adapted to be rotated alternately in opposite directions, wherein a yarn is passed through said hollow spindle to have alternate twist imparted thereto.

Figure 2:
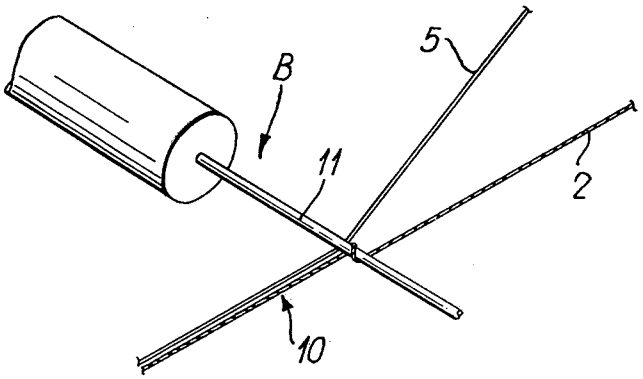
FIG. 2 is a perspective view of a twist arresting mechanism in a second operating station.

At the second operating station, there is provided a mechanism for maintaining the elastic and non-elastic yarns stationary during the twisting operation at the first and third stations A and C. This mechanism may be in the form of a needle-like member 11 extending at right angles with the direction of travel of the yarn, as shown in FIG. 2. The non-elastic yarn 2 can be held stationary simply by wrapping it a single turn around the needle-like member 11 and the elastic yarn can be held stationary simply by contacting it therewith. When the needle-like member 11 is stationary, the twisting actions by the twisting mechanisms 4 and 6 do not extend to the opposite side beyond the needle-like member 11, so that on opposite sides of the needle-like member, it is possible to apply twist in opposite directions at the same time without inconvenience.

If the needle-like member 11 shown in FIG. 2 is rotated clockwise as viewed in the figure, it follows that the elastic and non-elastic yarns 5 and 2 are forwardly delivered. Therefore, the needle-like member 11 also serves to forwardly deliver the first-twisted non-elastic yarn while effectively retaining the twist. As for the rotation of the needle-like member 11, it may be driven by power in interlocking relation to clipping mechanisms to be later described.

In order to further ensure the doubling of the elastic and non-elastic yarns 5 and 2, the needle-like member 11 may be provide with a suitable guide projection (not shown).

The twist arresting mechanism is not limited to said needle-like member. For example, it may be a pulley like the pulley 3 or it may be a mechanism adapted to temporarily clip the yarn. What is essential is that the twist action should not extend to the opposite side beyond the second operating station.

The distance *b* between the first and second operating stations A and B is equal to the distance *c* between the second and third operating stations B and C. The distance *a* between the guide pulley 3 and the first operating station A should, if possible, be equal to the distance *b* or *c*. The distance *d* between the third operating station C and the guide pulley 7 may or may not be equal to the distance *a* or b.

According to the invention, a non-elastic yarn clipping mechanism movable between the first and second operating stations and a doubled-yarn clipping mechanism movable between the second and third operating stations are provided. An example of such clipping mechanism is shown in FIG. 3.

Figures 3, 4:
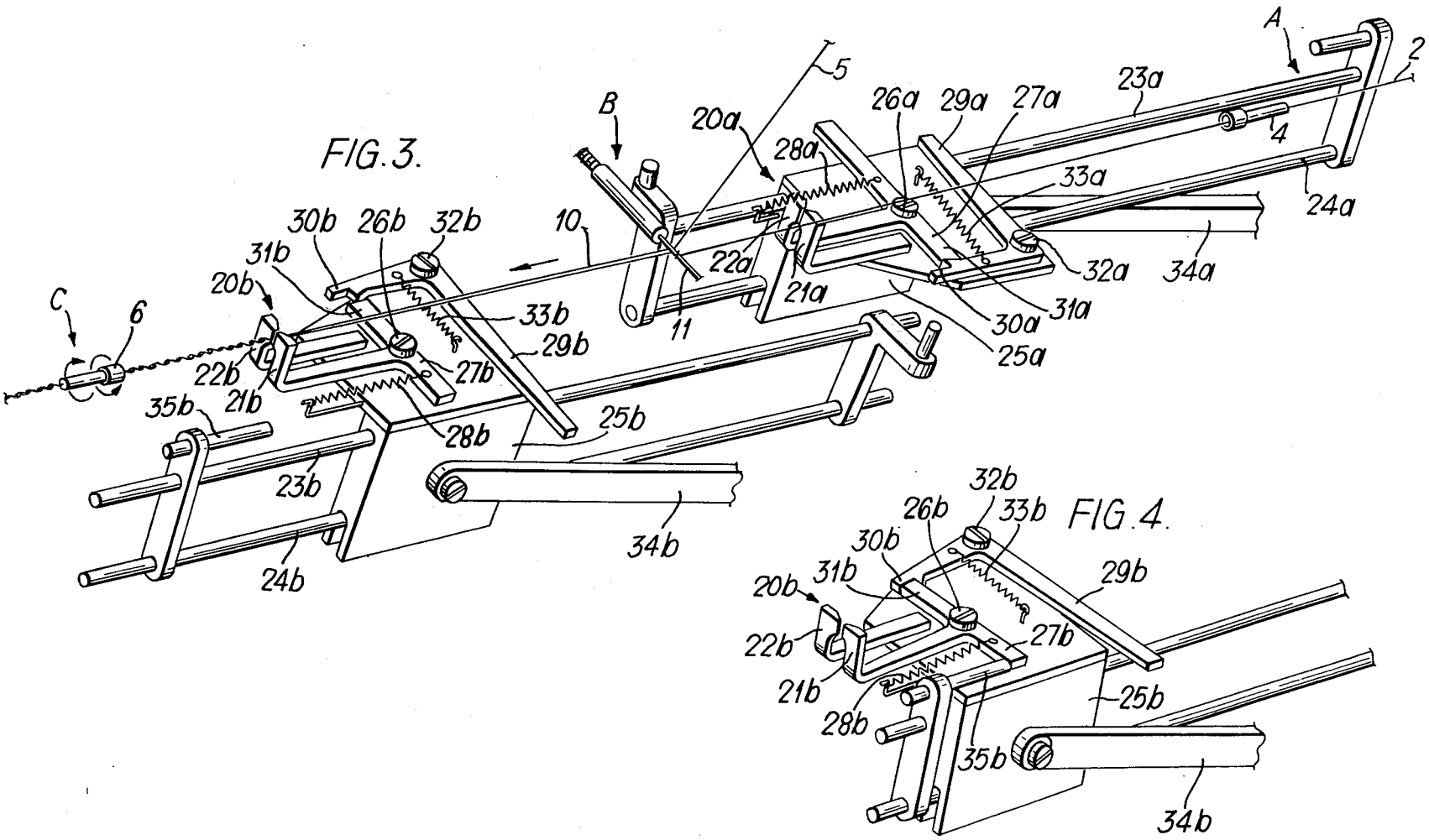
FIG. 3 is an enlarged perspective view of an example of a clipping mechanism employed in the present invention.
FIG. 4 is a perspective view showing the opened condition of one of the clipping mechanisms shown in FIG. 3.

In FIG. 3, collectively designated at 20*a* and 20*b* are a clipping mechanism movable between the first and second operating stations and a clipping mechanism movable between the second and third operating stations, respectively. The clipping mechanism 20*a* and 20*b* are different in design but are the same in function and hence only the clipping mechanism 20*a* will be fully described below.

The clipping mechanism 20*a* has fixed and movable clipping dogs 21*a* and 22*a*, respectively. The fixed clipping dog 21*a* is fixed to a slide 25*a* slidable from the first operating station A to the second operating station B along parallel guide bars 23*a* and 24*a*, while the movable clipping dog 22*a* is pivotally mounted on said slide 25*a* by a pin 26*a*. The movable clipping dog 22*a* has an operating lever portion 27*a* extending at right angles with a line joining the dog front portion and the pin 26*a*. The operating lever portion 27*a* is provided with a spring 28*a* for giving the movable dog 22*a* a turning moment directed clockwise as viewed in the figure. The end of the operating lever portion 27*a* opposite to the spring 28*a* with respect to the pin 26*a* is provided with an engagement portion 31*a* engageable with a latch 30*a* formed at the front end of a release lever 29*a*. The release lever 29*a* is pivotally mounted on the slide 25*a* by a pin 32*a* and is provided with a spring 33*a*.

In the condition shown in FIG. 3, the latch 30*a* at the front end of the release lever 29*a* is out of engagement with the engagement portion 31*a* at the front end of the operating lever portion 27*a*, wherein the tip of the movable dog 22*a* is pressed against the tip of the fixed dog 21*a* by the action of the spring 28*a*, thus clipping therebetween the non-elastic yarn 2 extending between the first and second operating stations.

In the figure, 34*a* designates an operating connecting rod for moving the slide 25*a*, said rod being suitably connected to a power-driven mechanism.

As described above, the clipping mechanism 20*b* is constructed in the same manner as the clipping mechanism 20*a*. The parts of the clipping mechanism 20*b* which correspond to those of the clipping mechanism 20*a* are indicated by the same reference numerals with the suffix *a* changed to *b*. The corresponding parts are of the same construction and perform the same function.

In order to release the dogs 21*a* and 22*b* from pressed contact with the dogs 21*a* and 21*b* in the clipping mechanisms 20*a* and 20*b*, this may be achieved by turning the operating lever portions 27*a* and 27*b* against the force of the springs 28*a* and 28*b* so as to allow the engagement portions 31*a* and 31*b* to engage the latches 30*a* and 30*b* of the release levers 29*a* and 29*b*, respectively. FIG. 4 shows the dogs 21*b* and 22*b* in the clipping mechanism 20*b* released from mutual pressed contact. In FIG. 4, when the slide reaches the end of its stroke, a stopper 34*b* fixed in position is engaged by the right end of the operating lever portion 27*b*, so that the latter is turned counterclockwise, thus releasing the dogs 21*b* and 22*b* from mutual pressed contact. The dogs 21*a*, 22*a* and 21*b*, 22*b* will maintain their condition (opened condition) unless the release levers 29*a*, 29*b* are turned against the force of the springs 33*a*, 33*b*.

Since it is preferable that the clipping mechanisms 20*a* and 20*b* be simultaneously moved, as will be later described, it is desirable to interconnect the connecting rods 34*a* and 34*b* so that they move in interlocked relation.

The operation will now be described.

In FIG. 1, with all yarns at rest, the first-twisting spindle 4 is rotated clockwise as viewed in the direction of yarn travel while the second-twisting spindle 6 is turned counterclockwise. During this operation, the clipping mechanisms 20*a* and 20*b* of FIG. 3, in their opened condition not clipping the yarn, are retracted from the second to the first operating station and from the third to the second operating station, respectively.

As a result of the clockwise rotation of the first-twisting spindle 4, the portion of the non-elastic yarn 2 in the region *a* is given Z-twist while the portion of the non-elastic yarn 2 in the region *b* is given S-twist. Concurrently therewith, as a result of the counterclockwise rotation of the second-twisting spindle 6, the doubled yarn 10 composed of the first-twisted non-elastic yarn and the elastic yarn which is in stretched condition is given second S-twist in the region *c* and second Z-twist in the region *d*.

When the non-elastic yarn 2 and the doubled yarn 10 are given a fixed amount of first and second twist, respectively, the rotation of the first-twisting and second-twisting spindles 4 and 6 is stopped. Subsequently, the non-elastic yarn 2 is clipped by the clipping mechanism 20*a* shown in FIG. 3 immediately after leaving the first-twisting spindle 4 while the doubled yarn 10 composed of the elastic and non-elastic yarns is clipped by the clipping mechanism 20*b* immediately after leaving the needle-like member 11. With such clipped condition maintained, the yarns 2, 5 and 10 are forwardly delivered until the clipping mechanism 20*a* reaches the second operating station and the clipping mechanism 20*b* reaches the third operating station. In this case, if possible, the non-elastic yarn may be clipped by a clipping mechanism similar to the clipping mechanism 20*a* or 20*b* immediately after leaving the guide pulley 3 and moved to the first operating station.

As a result, fresh non-elastic yarn is introduced into the region *a*; the non-elastic yarn which is given Z-twist in the region *a* is introduced into the region *b*; the non-elastic yarn which is given second S-twist in the region *b* is introduced into the region *c* along with fresh elastic yarn which is in stretched condition; and the doubled yarn which is given second S-twist in the region *c* is moved to the region *d* and leaving the guide pully 7 it is wound on the cheese 9 via the dancing pully 8.

The travel of each yarn is then stopped again, and after the clipping action by each clipping mechanism is removed, the spindles 4 and 6 are rotated in the opposite direction. That is, the spindle 4 is rotated counterclockwise while the spindle 6 is rotated clockwise. As a result, the portion of the non-elastic yarn in the region *a* is given S-twist while the portion of the non-elastic yarn which transferred to the region *b* after having been given Z-twist in the region *a* is given twist in the same direction, namely, Z-twist, whereupon the first-twisting of the non-elastic yarn is completed. Further, the portion of the non-elastic yarn which has been previously given S-twist in the region *b* is introduced into the region *c* along with the elastic yarn 5 which is in stretched condition, where they are given second Z-twist by the spindle 6. This means that the doubled yarn 10 is given second twist which has the direction opposite to that of the first twist given to the non-elastic yarn. The portion of the doubled yarn previously given S-twist in the region *c* has been moved to the region *d*, where it is further second-twisted in the S-direction by the clockwise rotation of the spindle, whereby the second-twisting is completed.

During the rotation of the spindles 4 and 6 described above, the clipping mechanisms, in opened condition, are being moved back to their respective initial positions.

When the yarn portions in the respective regions have been given respective fixed amounts of twist, the rotation of the spindles 4 and 6 is stopped again, whereupon the yarn portions in the regions *a*, *b* and *c* are advanced from the initial to the terminal end while being clipped by the clipping mechanisms, and then the same operations will be repeated.

By repetition of the operations described above, the non-elastic yarn is given alternate first-twist in opposite directions over fixed lengths and with this condition maintained it is doubled with the elastic yarn 5 which is in stretched condition, the doubled yarn 10 being then given second twist which has the direction opposite to that of the first twist given to the non-elastic yarn 2. Thus, the doubled yarn, after being given alternate twist in opposite directions over fixed lengths, can be properly delivered and wound on the cheese 9 without the possibility of the second twist being lost since the non-elastic yarn has been given first twist in opposite directions in advance. In this invention, therefore, the pressing process such as heat setting for setting the second twist is absolutely unnecessary.

As for preferable operating conditions, the regions *a*, *b*, *c* and *d* may have a length of 1 meter each; the number of revolutions of the spindles 4 and 6 during a run may be 250–350; and the rate of delivery of yarn may be 100–150 meter per minute. Although the delivery of the elastic and non-elastic yarns 5 and 2 is intermittent, the winding operation by the winding mechanism may be made continuous by using the dancing pulley 8, as shown in FIG. 1, which may be swung to allow the winding operation to be continuously performed even when the doubled yarn is not delivered. Further, it is necessary that the elastic yarn 5 be stretched 3–4 times when supplied and that the supply thereof be intermittent. Therefore, a mechanism for stretching the leastic yarn 5 and another mechanism for deliverying it in fixed lengths are needed. The arrangement of such devices is optional and not limited.

According to the present invention, as described above, an alternately twisted doubled yarn of elastic and non-elastic yarns can be purely mechanically, efficiently produced in flow process without requiring any special processes including heat setting. Thus, the invention is far more advantageous than the conventional method and apparatuses in respect of labor cost, power cost, equipment cost, area of installation, et.

What I claim is:

1. A method for producing a doubled-yarn package of elastic and non-elastic yarns, comprising the step of imparting first-twist to a non-elastic yarn alternately in opposite directions at a first operating station, doubling an elastic yarn which is in a stretched condition with said first-twisted non-elastic yarn at a second operating station, and imparting second-twist to the doubled-yarn alternately in opposite directions at a third operating station and then winding it on a winding core such as a cheese or cone, wherein the first twisting of the non-elastic yarn at said first operating station and the second twisting of the doubled yarn at said third operating station are simultaneously effected with the feeding of the respective yarns stopped, the directions of the first twist at said first operating station being opposite to the directions of the second twist at said third operating station, the elastic and non-elastic yarns at said second operating station being held stationary during the twisting operations at said first and third operating stations, and wherein after the first and second twists have been imparted in fixed amounts and in fixed directions on both sides of said second operating station, the first and second twisting operations at said first and third operating stations, respectively are stopped, whereupon the second-twisted doubled yarn and the first-twisted non-elastic yarn are clampld immediately after they leave the second and first operating stations, respectively, whereupon they are forwardly moved until their clamped positions reach the third and second operating stations, respectively.

2. A method for producing a doubled yarn package of elastic and non-elastic yarns as defined in claim 1, in which said elastic yarn is elastic synthetic fiber and said non-elastic yarn is a stretch yarn made of polyamide.

3. A method for producing a double yarn package of elastic and non-elastic yarns as defined in claim 2, in which said elastic synthetic fiber is polyurethane fiber.

4. A method for producing a doubled yarn package of elastic and non-elastic yarns as defined in claim 3, in which said elastic yarn of polyurethane fiber is doubled in such a stretched condition as have three to four times its free length together with said non-elastic yarn.

5. Apparatus for producing a doubled-yarn package of elastic and non-elastic yarns, comprising a first operating station provided with a non-elastic yarn first-twisting mechanism for imparting first-twist to a non-elastic yarn a second operating station spaced a fixed distance forwardly of said first operating station and adpated to double an elastic yarn which is in stretched condition with said non-elastic yarn first-twisted by said first-twisting mechanism, a third operating station spaced a fixed distance forwardly of said second operating station and provided with a second-twisting mechanism for imparting second-twist to the doubled yarn composed of said elastic yarn and first-twisted non-elastic yarn, a winding mechanism spaced forwardly of said third operating station for winding the doubled yarn second-twisted at said third operating station, said second operating station being provided with a twist retaining mechanism for arresting said elastic and non-elastic yarns, a first-twisted non-elastic yarns clipping mechanism movable from said first to said second operating station.

* * * * *